United States Patent [19]

Popa

[11] 4,293,833

[45] Oct. 6, 1981

[54] MILLIMETER WAVE TRANSMISSION LINE USING THALLIUM BROMO-IODIDE FIBER

[75] Inventor: Adrian E. Popa, Newbury Park, Calif.

[73] Assignee: Hughes Aircraft Company, Culver City, Calif.

[21] Appl. No.: 90,233

[22] Filed: Nov. 1, 1979

[51] Int. Cl.[3] ..... H01P 3/16

[52] U.S. Cl. ..... 333/239; 333/242

[58] Field of Search ..... 333/236, 239–242; 350/96.34

[56] References Cited

PUBLICATIONS

Chandler, C. H., *An Investigation of Dielectric Rod as Wave Guide,* Jrnl. of Applied Physics, vol. 20, Dec. 1949, pp. 1188–1192.

Rodney et al., *Refraction and Dispersion of Thallium Bromide Iodide,* Jrnl. of the Optical Soc. of America, vol. 46, No. 11, Nov. 1956, pp. 956–961.

Pinnow et al., *Polycrystalline Fiber Optical Waveguides for Infrared Transmission,* IEEE Jrnl. of Quantum Electronics, QE-13, No. 9, Sep. 1977, p. 91D.

Von Hippl, A. R., *Dielectric Materials and Applications,* Technology Press of MIT and John Wiley, N.Y., 1954, p. 302.

*Primary Examiner*—Paul L. Gensler

*Attorney, Agent, or Firm*—Kenneth W. Float; William H. MacAllister; Paul M. Coble

[57] ABSTRACT

Millimeter wave transmission lines are disclosed for propagating electromagnetic waves of a wavelength ranging from about 10 mm to about 0.4 mm. The transmission lines comprise a fiber of co-crystallized thallium bromo-iodide consisting of from about 40 mole percent to about 46 mole percent thallium bromide and from about 60 mole percent to about 54 mole percent thallium iodide. The fiber may be cladded with a dielectric material having a dielectric constant less than that of the fiber. A number of alternate fiber and cladding cross-sectional configurations are disclosed including circular, square, rectangular, and elliptical.

14 Claims, 10 Drawing Figures

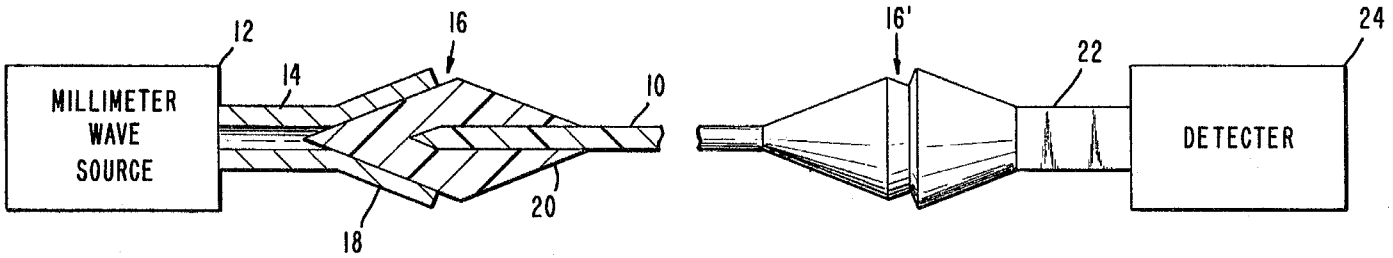
Fig. 1.
Fig. 2.
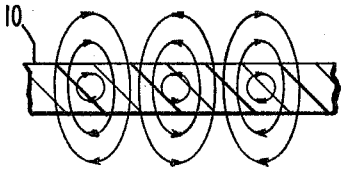
Fig. 3.
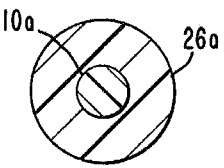
Fig. 4.
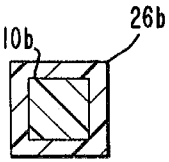
Fig. 5.
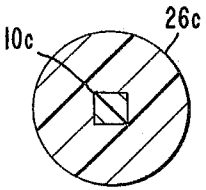
Fig. 6.
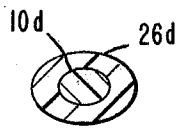
Fig. 7.
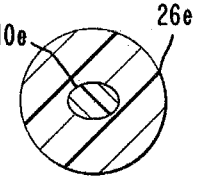
Fig. 8.
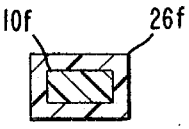
Fig. 9.
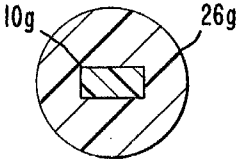
Fig. 10.

MILLIMETER WAVE TRANSMISSION LINE USING THALLIUM BROMO-IODIDE FIBER

TECHNICAL FIELD

This invention relates to electromagnetic wave transmission, and more particularly it relates to dielectric fiber transmission lines for millimeter waves.

BACKGROUND ART

The use of dielectric rods as waveguides for propagating electromagnetic waves in the microwave and millimeter wave region of the spectrum is well known: see "An Investigation of Dielectric Rod as Wave Guide", by C. H. Chandler, *Journal of Applied Physics,* Vol. 20 (December 1949), pages 1188–1192.

In the past waveguides of the foregoing type usually were constructed with materials having relatively low dielectric constants (e.g., polystyrene, quartz, and Teflon). In order for propagating millimeter waves to be confined within rods of low dielectric constant material, rod diameters are required which are excessively large for a number of applications. On the other hand, when such rods are only a fraction of a wavelength in diameter, the greater part of the propagating wave energy lies outside of the rod, creating evanescent fields which make it extremely difficult to support the rods in a practical manner. Moreover, when dielectric rods which propagate large evanescent fields are bent or have other surface imperfections, considerable power may be lost by radiation.

Alternatively, previous rod waveguide materials with high dielectric constants (e.g. gallium arsenide, silicon, and sapphire) were quite rigid, and waveguides which could be fabricated from these materials were limited to a few centimeters in length. Thus, flexible, long, readily supportable dielectric rod waveguides for millimeter waves were beyond the state of the art.

A further area of prior art of relevance to the present invention but which heretofore was never associated with millimeter wave propagation is that relating to optical waveguides using fibers of thallium bromo-iodide, alternatively known as KRS-5. Crystals of thallium bromo-iodide have long been used for the refraction and dispersion of light, particularly at infrared wavelengths, as discussed in a paper by William S. Rodney and Irving H. Malitson, "Refraction and Dispersion of Thallium Bromide Iodide", *Journal of the Optical Society of America,* Vol. 46, No. 11 (November 1956), pages 956–961. More recently, extrusion techniques have been devised for producing co-crystalized fibers of thallium bromo-iodide in continuous lengths of up to 200 meters. These extrusion techniques are described in detail in patent application Ser. No. 37,581, filed May 9, 1979 by Douglas A. Pinnow et al and entitled "Infrared Transmitting Fiber Optical Waveguides Extruded from Halides", which application is a continuation of application Serial No. 800,149, filed May 24, 1977, now abandoned and in a paper by D. A. Pinnow et al "Polycrystalline Fiber Optical Waveguides for Infrared Transmission", *IEEE Journal of Quantum Electronics,* QE-13, No. 9 (September 1977), page 91D.

Thallium bromo-iodide fibers made by the aforementioned extrusion techniques have been found to be optically transparent over a range of light wavelengths from approximately 0.6 μm in the visible region to approximately 35 μm in the infrared region, and hence are particularly suited for use as a fiber optical waveguide for the transmission of light at infrared wavelengths. However, prior to the present invention there was nothing to suggest that such fibers also could be used for propagating electromagnetic waves at millimeter wavelengths. In fact there is a dearth of published literature on appropriate parameter values (e.g. dielectric constant and loss tangent) which would give any clue to the usefulness of co-crystalized thallium bromo-idoide for millimeter wave propagation.

More specifically, in the book by A. R. Von Hippel, *Dielectric Materials and Applications,* Technology Press of MIT and John Wiley, New York (1954), page 302, values are given for the dielectric constant and loss tangent of thallium bromo-iodide for a number of radio frequencies ranging from 100 Hz to 10 MHz; however, no values are given corresponding to wavelengths shorter than 30,000 mm. The only other previous radio frequency measurements known for thallium bromo-iodide are the dielectric constant measurements of R. C. Powell of the National Bureau of Standards Boulder Laboratories at wavelengths of 300 mm and 1500 mm, and which are given on page 958 of the aforementioned Rodney and Malitson paper.

SUMMARY OF THE INVENTION

It is an object of the present invention to provide a highly flexible dielectric fiber transmission line for propagating electromagnetic waves at millimeter wavelengths which retains the evanescent energy of the propagating waves close to the fiber, thereby facilitating arrangement and support of the transmission line in a practical and effective manner.

It is a further object of the invention to provide a low-loss, flexible millimeter wave fiber transmission line of small cross-sectional dimensions and long length.

It is still another object of the invention to provide a millimeter wave fiber transmission line which is less sensitive to bends and surface imperfections in the transmission line medium than millimeter wave dielectric rod transmission lines of the prior art.

A transmission line according to the invention comprises a fiber of co-crystalized thallium bromo-iodide consisting of from about 40 mole percent to about 46 mole percent thallium bromide and from about 60 mole percent to about 54 mole percent thallium iodide. The fiber is used to propagate electromagnetic waves of a wavelength ranging from about 10 mm to about 0.4 mm.

Additional objects, advantages, and characteristic features of the invention will become readily apparent from the following detailed description of preferred embodiments of the invention when considered in conjunction with the accompanying drawing.

BRIEF DESCRIPTION OF THE DRAWING

In the accompanying drawing:

FIG. 1 is a side view, partly in section and partly in block form, illustrating a millimeter wave transmission line according to one embodiment of the invention coupled to a millimeter wave source and a detector;

FIGS. 2 and 3 are cross-sectional and longitudinal sectional views, respectively, illustrating an exemplary electromagnetic field pattern for millimeter waves propagating along the transmission line of FIG. 1; and FIGS. 4–10 are cross-sectional views showing various clad millimeter wave transmission lines according to respective further embodiments of the invention.

DETAILED DESCRIPTION OF THE INVENTION

Referring to FIG. 1 with greater particularity, a millimeter wave transmission line according to the invention utilizes a fiber 10 of co-crystalized thallium bromo-iodide, alternatively known as KRS-5. The composition of the fiber 10 preferably ranges from about 40 mole percent to about 46 mole percent thallium bromide and from about 60 mole percent to about 54 mole percent thallium iodide. A specific exemplary composition which has been employed consists of 45.7 percent thallium bromide and 54.3 mole percent thallium iodide. In the embodiment shown in FIG. 1, the fiber 10 has a circular cross-section, although as discussed in more detail below, a number of other cross-sectional configurations are also suitable and may be used instead. Exemplary diameters for the fiber 10 range from about 0.1 mm to about 3 mm. Exemplary fiber lengths range from a few centimeters to hundreds of meters.

The fiber 10 may be fabricated by heating billets of thallium bromo-iodide in a screw press to a temperature of from about 200° C. to about 350° C. (which is below the 414° C. melting point of thallium bromo-iodide). The press is provided with an orifice having a diameter corresponding to the desired diameter of the fibers being fabricated. The press piston is advanced until sufficient pressure is provided to cause the fiber to be extruded through the orifice. Typical extrusion rates are about several centimeters per minute. For further details concerning fabrication of the fiber 10, reference may be to the aforementioned patent application Ser. No. 37,581, now abandoned.

Measurements of the dielectric constant ($\epsilon$) and the loss tangent (tan $\delta$) of a fiber 10 of the aforementioned specific exemplary composition of thallium bromo-iodide at the millimeter wavelengths of 8.6 mm and 3.2 mm have indicated a high dielectric constant ($\epsilon=32$) together with an unexpected low loss tangent (tan $\delta=2\times10^{-3}$), which is less than one-tenth of the loss of a hollow rectangular metallic waveguide at the frequencies in question. This surprising combination of parameters makes thallium bromo-iodide fiber 10 especially suitable for propagating electromagnetic waves in the millimeter region of the spectrum, i.e. at wavelengths ranging from about 10 mm to about 0.4 mm. The latter wavelength is the estimated upper wavelength limit of the reststrahlen region which is characterized by absorption resonances in the molecular structure.

Referring again to FIG. 1, millimeter waves to be launched onto the fiber 10 may be generated by a suitable millimeter wave source 12 such as an IMPATT diode, klystron, or traveling-wave tube. In the arrangement shown in FIG. 1, millimeter waves from the source 12 initially propagate along a hollow rectangular metallic waveguide 14 and are then launched onto the fiber 10 by means of a transition coupler 16. However, it should be understood that, alternatively, millimeter waves may be launched onto the fiber 10 directly from the source 12. Moreover, the particular transition coupler 16 illustrated in FIG. 1 is only exemplary, and a number of other coupling arrangements may be employed instead.

In the specific exemplary arrangement shown in FIG. 1, the end of the waveguide 14 away from the source 12 defines a flared transition portion 18 having a cross-section which gradually changes from rectangular to circular. The end of the fiber 10 onto which the millimeter waves are lauched is disposed within a plug 20 defining a pair of conically tapered ends, the end away from the fiber 10 being inserted within the waveguide flared portion 18. The plug 20 is preferably of a dielectric material having a dielectric constant less than that of the fiber 10, an exemplary material being Teflon.

At the other end of the fiber 10 a like transition coupler 16' removes the propagating millimeter waves from the fiber 10 and launches them onto a hollow rectangular waveguide 22 for travel to a suitable detector 24 such as a Schottky diode. As specific example solely for illustrative purposes, when the arrangement of FIG. 1 is used to propagate millimeter waves at a wavelength of 3.2 mm, the waveguides 14 and 22 may have cross-sectional dimensions of 2.5 mm by 1.25 mm, with the fiber 10 having a diameter of 0.5 mm.

An exemplary electromagnetic field pattern ($HE_{11}$ mode) for millimeter waves propagating along the fiber 10 is illustrated in FIGS. 2 and 3. As may be seen, in contrast to low dielectric constant rod transmission lines of the prior art wherein evanescent fields propagate outside of the rod to a distance of several centimeters, with a transmission line according to the present invention evanescent fields extend radially outwardly from the fiber 10 by only a few millimeters. Thus, millimeter wave transmission lines according to the invention may be arranged and supported far more practically and effectively than heretofore has been possible. In addition, a millimeter wave transmission line according to the invention is considerably less sensitive to bends and surface imperfections in the transmission line medium than millimeter wave dielectric rod transmission lines of the prior art. Moreover, transmission lines according to the invention have low loss, are flexible, and may be fabricated in very long lengths.

The radial extent to which electromagnetic energy propagates outside of a transmission line according to the invention may be reduced still further or even eliminated entirely by disposing a cladding of low-loss dielectric material having a dielectric constant less than that of the fiber 10 about the lateral surface of the fiber 10. This enables millimeter wave transmission lines according to the invention to be routed and supported in a manner similar to optical fibers or coaxial cables. Exemplary cladding materials which may be employed are Telfon and polystyrene, although it should be understood that other cladding materials are also suitable and may be used instead. The cladding may be either coextruded with the fiber 10 or coated on the fiber surface after the fiber 10 has been extruded.

A number of alternate milimeter wave transmission line configurations employing clad thallium bromo-iodide fibers according to respective further embodiments of the invention are illustrated in FIGS. 4–10.

In the embodiment of FIG. 4 fiber **10*a* of circular cross-section is shown disposed within cladding 26*a*** which has a circular cross-sectional perimeter.

In the embodiments of FIGS. 5 and 6, the respective fibers **10*b* and 10*c* both have a square cross-section. However, cladding 26*b* of FIG. 5 has a square cross-sectional perimeter, while the cross-sectional perimeter of cladding 26*c* of FIG. 6** is circular.

In the embodiments FIGS. 7 and 8, respective fibers **10*d* and 10*e* are both shown as having an elliptical cross-section. Elliptically cross-sectioned fibers such as 10*d* and 10*e* typically may be dimensioned with a major axis-to-minor axis ratio of about two-to-one. In the embodiment of FIG. 7 cladding 26*d* has an elliptical cross-sectional perimeter, while cladding 26***e* of the embodiment of FIG. 8 has a circular cross-sectional perimeter.

In the embodiments of FIGS. 9 and 10, respective fibers 10*f* and 10*g* both have a rectangular cross-section, typically dimensioned with a side length ratio of two-to-one. Cladding 26*f* in the embodiment of FIG. 9 has a rectangular cross-sectional perimeter, while the cross-sectional perimeter of cladding 26*g* of FIG. 10 is circular. Non-circular cross-sectioned fibers 10*b*–10*g* are especially useful for preserving millimeter wave polarization around bends, twists, or loops in the fiber.

Although the present invention has been shown and described with reference to particular embodiments, nevertheless, various changes and modifications which are obvious to a person skilled in the art to which the invention pertains are deemed to lie within the spirit, scope, and contemplation of the invention.

What is claimed is:

1. A transmission line comprising:

a fiber of co-crystalized thallium bromo-iodide consisting of from about 40 mole percent to about 46 mole percent thallium bromide and from about 60 mole percent to about 54 mole percent thallium iodide, and means for launching electromagnetic waves of a wavelength ranging from about 10 millimeters to about 0.4 millimeter onto said fiber.

2. A transmission line according to claim 1 wherein said fiber has a transverse extent ranging from about 0.1 millimeter to about 3 millimeters.

3. A transmission line according to claim 1 wherein a cladding of a dielectric material having a dielectric constant less than that of said fiber is disposed about the lateral surface of said fiber.

4. A transmission line according to claim 3 wherein said fiber has a circular cross-section, and said cladding has a circular cross-sectional perimeter.

5. A transmission line according to claim 3 wherein said fiber has a square cross-section, and said cladding has a square cross-sectional perimeter.

6. A transmission line according to claim 3 wherein said fiber has a square cross-section, and said cladding has a circular cross-sectional perimeter.

7. A transmission line according to claim 3 wherein said fiber has an elliptical cross-section, and said cladding has an elliptical cross-sectional perimeter.

8. A transmission line according to claim 3 wherein said fiber has an elliptical cross-section, and said cladding has a circular cross-sectional perimeter.

9. A transmission line according to claim 3 wherein said fiber has a rectangular cross-section, and said cladding has a rectangular cross-sectional perimeter.

10. A transmission line according to claim 3 wherein said fiber has a rectangular cross-section, and said cladding has a circular cross-sectional perimeter.

11. A transmission line according to any of claims 1, 2, 3, 4, 5, 6, 7, 8, 9, or 10 wherein said electromagnetic waves are of a wavelength ranging from about 8.6 millimeters to about 3.2 millimeters.

12. A method for transmitting millimeter wave energy comprising launching electromagnetic waves of a wavelength ranging from about 10 millimeters to about 0.4 millimeter onto a fiber of co-crystallized thallium bromo-iodide consisting of from about 40 mole percent to about 46 mole percent thallium bromide and from about 60 mole percent to about 54 mole percent thallium iodide, and removing said electromagnetic waves from said fiber.

13. A method according to claim 12 wherein said electromagnetic waves are of a wavelength ranging from about 8.6 millimeters to about 3.2 millimeters.

14. A new use for a KRS-5 waveguide which is comprised of co-crystalized thallium bromo-iodide having from about 40 mole percent to about 46 mole percent thallium bromide and from about 60 mole percent to about 54 mole percent thallium iodide, wherein said new use comprises:

utilizing said KRS-5 waveguide to transmit electromagnetic energy in the 0.4 to 10 millimeter wavelength range.

* * * * *